US005283169A

United States Patent [19]

Goto

[11] Patent Number: 5,283,169

[45] Date of Patent: Feb. 1, 1994

[54] SILVER HALIDE PHOTOGRAPHIC MATERIALS

[75] Inventor: Takahiro Goto, Kanagawa, Japan

[73] Assignee: Fuji Photo Film Co., Ltd., Ashigara, Japan

[21] Appl. No.: 803,432

[22] Filed: Dec. 6, 1991

[30] Foreign Application Priority Data

Dec. 7, 1990 [JP] Japan ..... 2-406199
Dec. 7, 1990 [JP] Japan ..... 2-406216

[51] Int. Cl.[5] ..... G03C 1/09

[52] U.S. Cl. ..... 430/603; 430/604; 430/605; 430/615; 430/264

[58] Field of Search ..... 430/603, 604, 605, 615, 430/264

[56] References Cited

U.S. PATENT DOCUMENTS 4,933,272 6/1990 McDugle et al. ..... 430/605
4,960,689 10/1990 Nishikawa et al. ..... 430/603
5,114,838 5/1992 Yamada ..... 430/603
5,229,263 7/1993 Yoshida et al. ..... 430/604

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A silver halide photographic material is disclosed, comprising a support having thereon at least one silver halide emulsion layer and the other hydrophilic colloid layer, wherein the emulsion layer comprises a silver halide emulsion containing a compound having a nitrosyl ligand or a thionitrosyl ligand per mol of silver and a transition metal selected from the group consisting of the elements belonging to Groups V to X of the periodic table in an amount of $1\times10^{-6}$ mol or more per mol of silver, and at least one of the silver halide emulsion layer and the other hydrophilic colloid layer contains at least one compound represented by formula (I), (II), (III), (IV) or (V).

(I)

(II)

$Z-SO_2-S-M$ (III)

(IV)

(V)

wherein each of $R^1$, $R^2$, $R^3$ and $R^4$, which may be the same or different, represents a hydrogen atom, an alkyl group, an aryl group, an amino group, a hydroxyl group, an alkoxy group, an alkylthio group, a carbamoyl group, a halogen atom, a cyano group, a carboxyl group, an alkoxycarbonyl group or a heterocyclic group, and $R^1$ and $R^2$ or $R^2$ and $R^3$ may combine together to form a five-membered or six-membered ring, provided that at least one of $R^1$ and $R^3$ represents a hydroxyl group and the total number of carbon atoms of $R^1$, $R^2$, $R^3$ and $R^4$ is at least 2; Z represents an alkyl group having 1 to 18 carbon atoms, an aryl group having 6 to 18 carbon atoms or a heterocyclic group; Y represents the atoms necessary to form an aromatic ring having 6 to 18 carbon atoms or a heterocyclic ring; M represents a metal atom or an organic cation; and n is an integer of 2 to 10.

4 Claims, No Drawings

SILVER HALIDE PHOTOGRAPHIC MATERIALS

FIELD OF THE INVENTION

The present invention relates to a silver halide photographic material, and more particularly to a silver halide photographic material treatable under substantial daylight conditions.

BACKGROUND OF THE INVENTION

In the field of print-duplication, improvements in working efficiency in the photomechanical process is required to improve the diversity and complexity of printed matter.

In particular, in the work of page make-up and dot to dot work stages, effort has been directed toward improving working efficiency by working under brighter light conditions. For this reason, bright room-type silver halide photographic materials for the photomechanical process which are treatable under daylight conditions and exposure printers have been developed.

The bright room-type silver halide photographic material described in this specification means a photographic material for which light free of ultraviolet light components and having a wavelength of 400 nm or more can be used as a safelight light.

The bright room-type silver halide photographic material for use in the work of page make-up and dot to dot work stages is a photographic material used to perform negative image/positive image conversion or positive/negative conversion using a processed film on which characters or halftone images are formed as an original, and by subjecting the original and a silver halide photographic material for dot to dot work to contact exposure. For these silver halide photographic materials, the following characteristics are required and bright room-type silver halide photographic materials for dot to dot work which meet the requirements have been developed:

(1) They must function to convert halftone dot images, line images and character images from negative images to positive images depending on the area of the halftone dot, the width of the line and the width of the character, respectively.

(2) They must function to control the tone of the halftone dot images and the line width of the character images and the line images.

However, bright room-type silver halide photographic materials have the disadvantage that the density of a portion ordinarily developed and turned black over the entire surface thereof tends to be significantly reduced, when under-exposure is used to control the tone of the halftone dot images in the dot to dot work stage using the above bright room-type silver halide photographic materials.

Methods for obtaining high contrast and an increase in Dmax by adding developing agents to silver halide photographic materials are disclosed in U.S. Pat. No. 4,617,258, JP-A No. 59-171947 (The term "JP-A" as used herein means an "unexamined published Japanese patent application"), JP-A Nos. 59-206828 and 1-262533. However, they do not satisfy all functions of safelight, shelf life and Dmax. In addition, methods in which impurities (heavy metals) are present in the crystals of the silver halides are disclosed in European Patent Nos. 336,427 and 336,689. However, the shelf life is inferior and the Dmax is not stable.

SUMMARY OF THE INVENTION

An object of the present invention is therefore to provide a bright room-type silver halide photographic material which can be treated under daylight conditions and which provides excellent dot to dot work function in a stable manner with a small density drop on under-exposure.

The above-described object of the present invention is achieved by a silver halide photographic material comprising a support having thereon at least one silver halide emulsion layer and another hydrophilic colloid layer, wherein the emulsion layer comprises a silver halide emulsion containing a compound having a nitrosyl ligand or a thionitrosyl ligand and a transition metal selected from the group consisting of elements belonging to Groups V to X of the periodic table in an amount of $1\times10^{-6}$ mol or more per mol of silver, and at least one of the silver halide emulsion layer and other hydrophilic colloid layer contains at least one compound represented by formula (I), (II), (III), (IV) or (V).

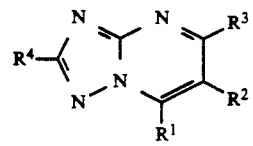

(I)

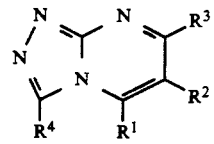

(II)

$$Z-SO_2-S-M \quad \text{(III)}$$

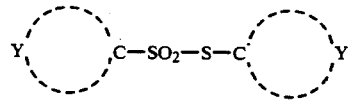

(IV)

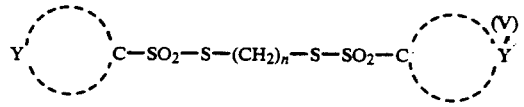

(V)

wherein each of $R^1$, $R^2$, $R^3$ and $R^4$, which may be the same or different, represents a hydrogen atom, an unsubstituted or substituted alkyl group, an unsubstituted or substituted aryl group, an unsubstituted or substituted amino group, a hydroxyl group, an alkoxy group, an alkylthio group, an unsubstituted or substituted carbamoyl group, a halogen atom, a cyano group, a carboxyl group, an alkoxycarbonyl group or a heterocyclic group, and $R^1$ and $R^2$ or $R^2$ and $R^3$ may combine together to form a five-membered or six-membered ring, provided that at least one of $R^1$ and $R^3$ represents a hydroxyl group and the total number of carbon atoms of $R^1$, $R^2$, $R^3$ and $R^4$ is at least 2; Z represents an alkyl group having 1 to 18 carbon atoms, an aryl group having 6 to 18 carbon atoms or a heterocyclic group; Y represents the atoms necessary to form an aromatic ring having 6 to 18 carbon atoms or a heterocyclic ring; M represents a metal atom or an organic cation; and n is an integer of 2 to 10.

DETAILED DESCRIPTION OF THE INVENTION

Six-coordinate complexes represented by the following formula are preferably used as compounds (i.e., transition metal coordinate complexes) to achieve the object of the present invention.

$$[M(NY)L_5]^m$$

wherein M represents a transition metal selected from the group consisting of elements belonging to Groups V to X of the periodic table; L represents a bridging ligand, provided that one of five L's may be NY (i.e., a nitrosyl ligand or a thionitrosyl ligand); Y represents oxygen or sulfur; and m is 0, −1, −2 or −3.

Preferred examples of bridged ligands for L other than nitrosyl and thionitrosyl bridged ligands include halide ligands (fluorides, chlorides, bromides and iodide), cyanide ligands, cyanate ligands, thiocyanate ligands, selenocyanate ligands, tellurocyanate ligands, acid ligands and aquo ligands. When the aquo ligand is present, it is preferred that the aquo ligand occupies one or two of the ligands.

Particularly preferred specific examples of M include rhodium, ruthenium, rhenium, osmium and iridium.

Specific examples of transition metal coordinate complexes are shown below:

1 $[Ru(NO)Cl_5]^{-2}$

2 $[Ru(NO)_2Cl_4]^{-1}$

3 $[Ru(NO)(H_2O)Cl_4]^{-1}$

4 $[Rh(NO)Cl_5]^{-2}$

5 $[Re(NO)Cl_5]^{-2}$

6 $[Re(NO)CN_5]^{-2}$

7 $[Re(NO)ClCN_4]^{-2}$

8 $[Rh(NO)_2Cl_4]^{-1}$

9 $[Rh(NO)(H_2O)Cl_4]^{-1}$

10 $[Ru(NO)CN_5]^{-2}$

11 $[Ru(NO)Br_5]^{-2}$

12 $[Rh(NS)Cl_5]^{-2}$

13 $[Os(NO)Cl_5]^{-2}$

14 $[Cr(NO)Cl_5]^{-3}$

15 $[Re(NO)Cl_5]^{-1}$

16 $[Os(NS)Cl_4(TeCN)]^{-2}$

17 $[Ru(NS)I_5]^{-2}$

18 $[Re(NS)Cl_4(SeCN)]^{-2}$

19 $[Os(NS)Cl(SCN)_4]^{-2}$

20 $[Ir(NO)Cl_5]^{-2}$

When the above-described metal complexes are present in silver halides, the complexes can be added during grain preparation.

In the present invention, the amount of the transition metals of the transition metal coordinate complexes in the silver halide grains is generally at least $1\times10^{-6}$ mol, preferably $1\times10^{-6}$ to $5\times10^{-4}$ mol, per mol of silver halide.

The transition metal may be added and uniformly distributed throughout the overall silver halide grain, but it is preferred that the transition metal is added so that it is present more in the outer shell region of the silver halide grain.

The silver halide emulsion for the silver halide photographic material of the present invention is preferably an emulsion comprising 90 mol % or more of silver chloride, for example, an emulsion comprising silver chlorobromide or silver iodochlorobromide containing 0 to 5 mol % of silver bromide. The increased content of silver bromide or silver iodide unfavorably causes a deterioration in safelight safety and a decrease in $\gamma$.

It is preferred that the silver halides used in the present invention are the so-called core/shell type silver halides. In particular, core/shell type silver halide grains with a higher amount of transition metal in the shell region than in the core region is preferably used.

In order to incorporate the above-described transition metal complex into the silver halide grain, the transition metal complex can be preferably added to a water-soluble silver salt or a halide solution when the water-soluble silver salt and the halide solution are simultaneously mixed. Alternatively, when three solutions may be used, a silver salt solution, the halide solution and a transition metal complex solution may be simultaneously mixed, thereby preparing the silver halide grains.

The silver halide emulsions used in the present invention preferably have a grain size of 0.20 μm or less.

When fine silver halide grains are prepared in the present invention, satisfactory results can be obtained at a temperature of generally 50° C. or less, preferably 40° C. or less, more preferably 30° C. or less, at a high stirring speed sufficient to achieve uniform mixing, at a silver potential of generally 70 mV or more, preferably 80 to 120 mV.

There is basically no restriction on the grain size distribution, but a monodisperse emulsion is preferred. The monodisperse emulsion used is composed of grains in which at least 95% by weight or by grain number of the total grains occupy ±40% and more preferably ±20%, of a mean grain size.

The silver halide grains used in the present invention preferably have a regular crystal form such as a cubic or a octahedral form, and a cubic form is particularly preferred.

The silver halide emulsions used in the present invention may be or may not be subjected to chemical sensitization. Sulfur sensitization, reduction sensitization, and noble metal sensitization are known as chemical sensitization, and any of these techniques may be used alone or in combination.

Gold sensitization representing an example of noble metal sensitization uses gold compounds, mainly gold complex salts. Complex salts of noble metals other than gold such as platinum, palladium and iridium may be present therein. Specific examples thereof are described in U.S. Pat. No. 2,448,060 and British Patent No. 618,061.

Sulfur sensitizers which can be used include various sulfur compounds such as thiosulfates, thioureas, thiazole compounds and rhodamine compounds, as well as the sulfur compounds present in gelatin.

Reduction sensitizers which can be used in the present invention include stannous salts, amines, formamidinesulfinic acid and silane compounds.

The compounds represented by formulae (I), (II), (III), (IV) and (V) which are used in the present invention are described in detail below.

In the above formulae, each of $R^1$, $R^2$, $R^3$ and $R^4$, which may be the same or different, represents a hydrogen atom; an unsubstituted or substituted alkyl group having 1 to 20 carbon atoms which may be a straight chain, branched or cyclic; an unsubstituted or substituted monocyclic or bicyclic aryl group; an unsubstituted or substituted amino group; a hydroxyl group; an alkoxy group having 1 to 20 carbon atoms; an unsubstituted or substituted alkylthio group having 1 to 6 carbon atoms; a carbamoyl group which may be substituted with an aliphatic group or an aromatic group; a halogen atom; a cyano group; a carboxyl group; an alkoxycarbonyl group of 2 to 20 carbon atoms; or a heterocyclic group containing a five-membered ring or a six-membered ring with one or more heteroatoms such as a nitrogen atom, an oxygen atom or a sulfur atom, and $R^1$ and $R^2$ or $R^2$ and $R^3$ may combine and form a five-membered or six-membered ring, provided that at least one of $R^1$ and $R^3$ represents a hydroxyl group.

Specific examples of the above-described unsubstituted alkyl groups include methyl groups, ethyl groups, n-propyl groups, i-propyl groups, n-butyl groups, t-butyl groups, hexyl groups, cyclohexyl groups, cyclopentylmethyl groups, octyl groups, dodecyl groups, tridecyl groups and heptadecyl groups. Examples of substituents of the above-described substituted alkyl groups include monocyclic or bicyclic aryl groups, heterocyclic groups, halogen atoms, carboxyl groups, alkoxylcarbonyl groups having 2 to 6 carbon atoms, alkoxy groups having 20 or less carbon atoms and hydroxyl groups. Specific examples of substituted alkyl groups include benzyl groups, phenethyl groups, chloromethyl groups, 2-chloroethyl groups, trifluoromethyl groups, carboxymethyl groups, 2-carboxyethyl groups, 2-(methoxycarbonyl)ethyl groups, ethoxycarbonylmethyl groups, 2-methoxyethyl groups, hydroxymethyl groups and 2-hydroxyethyl groups. Specific examples of the above-described unsubstituted aryl groups include phenyl groups and naphthyl groups. Examples of substituents of the substituted aryl groups include alkyl groups having 1 to 4 carbon atoms, halogen atoms, nitro groups, carboxyl groups, alkoxycarbonyl groups having 2 to 6 carbon atoms, hydroxyl groups and alkoxy groups having 1 to 6 carbon atoms. Specific examples of substituted aryl groups include p-tolyl groups, m-tolyl groups, p-chlorophenyl groups, p-bromophenyl groups, o-chlorophenyl groups, m-nitrophenyl groups, p-carboxyphenyl groups, o-carboxyphenyl groups, o-(methoxycarbonyl)phenyl groups, p-hydroxyphenyl groups, p-methoxyphenyl groups and m-ethoxyphenyl groups. Specific examples of unsubstituted or substituted alkylthio groups include

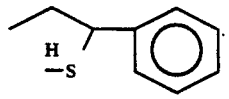

The amino group represented by each of $R^1$, $R^2$, $R^3$ and $R^4$ may be substituted. Examples of substituents include alkyl groups (for example, methyl, ethyl and butyl) and acyl groups (for example, acetyl and methylsulfonyl). Specific examples of substituted amino groups include dimethylamino groups, diethylamino groups, butylamino groups and acetylamino groups.

Specific examples of alkoxy groups represented by each of $R^1$, $R^2$, $R^3$ and $R^4$ include methoxy groups, ethoxy groups, butoxy groups and heptadecyloxy groups. The carbamoyl group represented by each of $R^1$, $R^2$, $R^3$ and $R^4$ may have one or two alkyl groups having 1 to 20 carbon atoms or one or two monocyclic or bicyclic aryl groups as substituents. Specific examples of substituted carbamoyl groups include methylcarbamoyl groups, dimethylcarbamoyl groups, ethylcarbamoyl groups and phenylcarbamoyl groups.

Specific examples of alkoxycarbonyl groups represented by each of $R^1$, $R^2$, $R^3$ and $R^4$ include methoxycarbonyl groups, ethoxycarbonyl groups and butoxycarbonyl groups.

Specific examples of halogen atoms represented by each of $R^1$, $R^2$, $R^3$ and $R^4$ include fluorine atoms, chlorine atoms and bromine atoms.

The heterocyclic groups represented by each of $R^1$, $R^2$, $R^3$ and $R^4$ may be a monocyclic ring or may have a bicyclic or tricyclic ring. Specific examples thereof include furyl groups, pyridyl groups, 2-(3-methyl)benzothiazolyl groups and 1-benzotriazolyl groups.

Examples of rings formed by $R^1$ and $R^2$ or $R^2$ and $R^3$ include a cyclopentane ring, a cyclohexane ring, a cyclohexene ring, a benzene ring, a furan ring, a pyrrolidine ring and a thiophene ring.

When $R^4$ represents the substituted alkyl group, a heterocyclic ring may be present as a substituent. A substituted alkyl group represented by the following formula is preferably present:

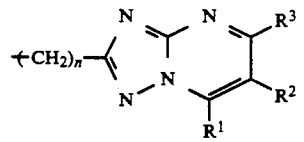

wherein $R^1$, $R^2$ and $R^3$ have the same meanings as given above, and n is 2 or 4.

In formula (III), (IV) or (V), the alkyl group, the aryl group and the heterocyclic group represented by Z and the aromatic ring and the heterocyclic ring represented by Y may be substituted.

Examples of substituents include lower alkyl groups such as methyl and ethyl; aryl groups such as phenyl; alkoxy groups having 1 to 8 carbon atoms; halogen atoms such as chlorine; nitro groups; amino groups; and carboxyl groups.

The heterocyclic rings represented by Z and Y include thiazole, benzothiazole, imidazole, benzimidazole and oxazole rings.

Preferred examples of metal atoms represented by M include alkali metal atoms such as a sodium and potassium. Preferred examples of organic cations include an ammonium ion and a guanidine group. Preferred groups represented by Z are alkyl groups having 1 to 12 carbon atoms.
Specific examples of compounds represented by formula (I), (II), (III), (IV) or (V) are shown below:
1
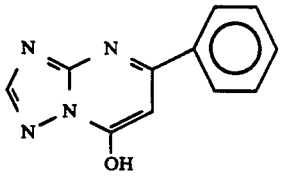
2
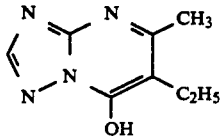
3
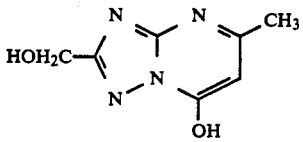
4
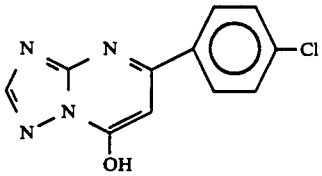
5
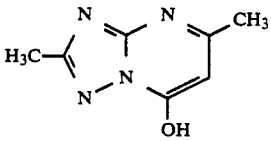
6
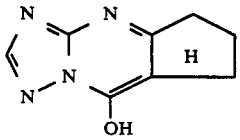
7
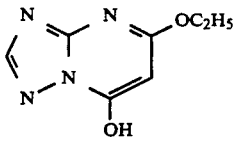
8
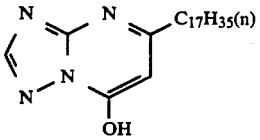
9
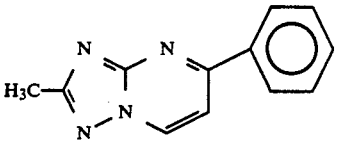
-continued
10
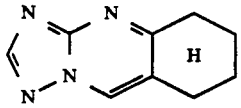
11
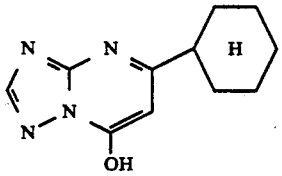
12
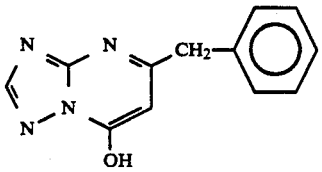
13
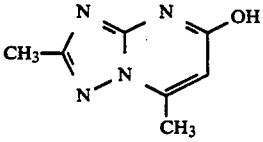
14
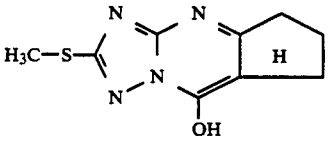
15
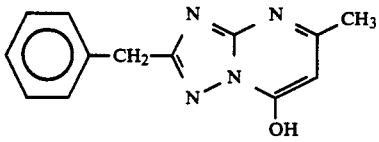
16
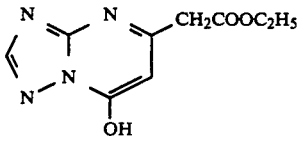
17
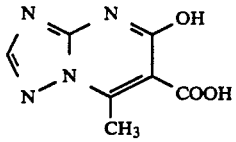
18
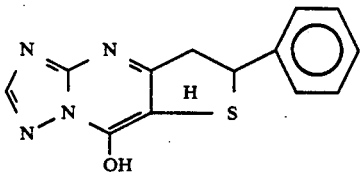
19
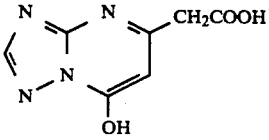

-continued

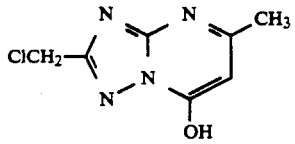

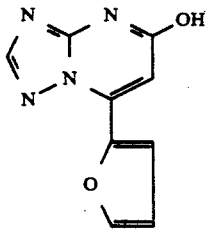

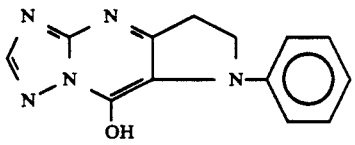

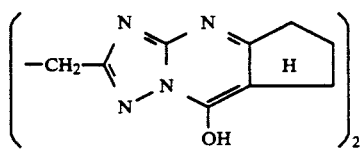

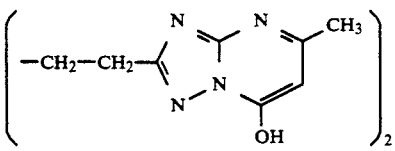

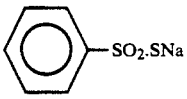

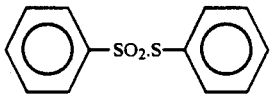

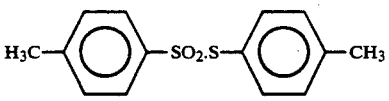

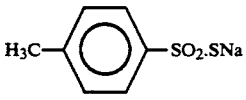

$H_3C.SO_2.SNa$

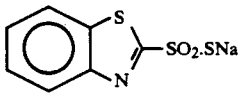

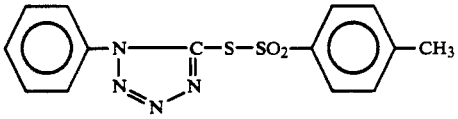

-continued

| | |
|---|---|
| $n\text{-}C_8H_{17}SO_2.SNa$ | 32 |
| $n\text{-}C_{12}H_{25}SO_2.SNa$ | 33 |
| $n\text{-}C_{16}H_{33}SO_2.SNa$ | 34 |

35

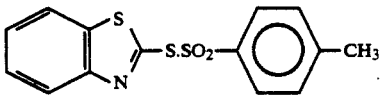

36

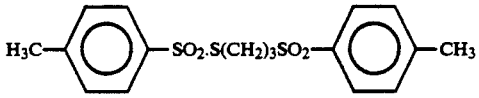

37

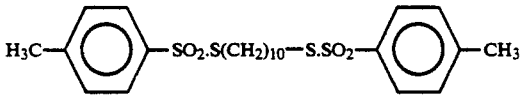

| | |
|---|---|
| 1-Cystine-disulfoxide | 38 |
| $C_2H_5.SO_2.SNa$ | 39 |
| $C_4H_9.SO_2.SNa$ | 40 |

The compounds represented by formula (I) can be easily synthesized by reference to the description in Bulow and Hass, *Berichte* 42, 4638 (1907); ibid. 43, 375 (1910); Allen et al., *J. Org. Chem.* 24, 796 (1959); De Cat and Dormael, *Bull. Soc. Chim. Belg.* 60, 69 (1951); and Cook et al., *Rec. Trav. Chem.* 69,343 (1950).

The compounds represented by formula (II) can be easily synthesized by reference to descriptions in Bower and Doyle, *J. Chem. Soc.* 1957, 727; and Allen et al., *J. Org. Chem.* 24, 787 (1959).

The compounds represented by formula (III), (IV) or (V) can be synthesized by methods generally known in the art.

For example, these compounds can be synthesized by reacting a corresponding sulfonyl fluoride compound with sodium sulfide or by reacting a corresponding sodium sulfinate compound with sulfur. On the other hand, these compounds are also available as commercial products.

In the present invention, it is preferred that the compounds represented by formula (I), (II), (III), (IV) or (V) be employed in an amount of $1\times10^{-5}$ to $1\times10^{-3}$ mol and particularly in an amount of $5\times10^{-5}$ to $1\times10^{-3}$ mol, per mol of silver halide. These compounds are present in at least one of the emulsion layer and the other hydrophilic colloid layer and preferably present in the emulsion layer. Particularly preferably, the compounds represented by formula (I) or (II) are present in the silver halide emulsion layer and the compounds represented by formula (III), (IV) or (V) are present in the other hydrophilic colloid layers. These compounds represented by formula (I), (II), (III), (IV) or (V) are added during grain formation, chemical ripening or immediately after coating. It is particularly preferred that they be added immediately after coating.

The hydrophilic colloid layers in the photographic materials of the present invention may contain water-soluble dyes as filter dyes, for preventing irradiation or for other various purpose. Such dyes include oxonol dyes, hemioxonol dyes, styryl dyes, merocyanine dyes, cyanine dyes and azo dyes. Of these dyes, oxonol dyes, hemioxonol dyes and merocyanine dyes are particularly useful.

Inorganic or organic hardening agents may be present in the photographic emulsions and insensitive hydrophilic colloids in the present invention.

Examples of suitable hardening agents include active vinyl compounds such as 1,3,5-triacryloylhexahydro-s-triazine, bis(vinylsulfonyl)methyl ether and N,N-methylenebis-[β-(vinylsulfonyl)propionamide; active halogen compounds such as 2,4-dichloro-6-hydroxy-s-triazine; mucohalogenic acids such as mucochloric acid; N-carbamoylpyridinium salts such as (1-morpholinocarbonyl-3-pyridinio)methanesulfonate; and haloamidinium salts such as 1-(1-chloro-1-pyridinomethylene)pyrrolizinium and 2-naphthalene sulfonate. These hardening agents may be used alone or in combination. Of these hardening agents, the active vinyl compounds described in JP-A Nos. 53-41220, 53-57257, 59-162546 and 60-80846 and the active halogen compounds described in U.S. Pat. No. 3,325,287 are preferred.

The photographic emulsion layers or other hydrophilic colloid layers of the photographic materials of the present invention may contain various surface active agents for various purposes, for example, as coating aids, as antistatic agents, for improvements in sliding properties, as emulsification and dispersing aids, for prevention of adhesion and for improvement in photographic characteristics (for example, development acceleration, increase in contrast, and increase in sensitivity).

Examples of suitable surface active agents include nonionic surface active agents such as saponin (steroid), alkylene oxide derivatives (such as polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, and polyethylene oxide adducts of silicone), glycidol derivatives (such as alkenylsuccinic acid polyglycerides and alkylphenol polyglycerides), fatty acid esters of polyhydric alcohols and alkyl esters of saccharides; anionic surface active agents containing acidic groups such as carboxyl groups, sulfo groups, phospho groups, sulfate groups and phosphate groups, such as alkyl carboxylates, alkyl sulfonates, alkylbenzenesulfonates, alkylnaphthalenesulfonates, alkyl sulfates, alkyl phosphates, N-acyl-N-alkyltaurine, sulfosuccinic acid esters, sulfoalkyl polyethylene alkylphenyl ethers and polyoxyethylene alkyl phosphates; amphoteric surface active agents such as amino acids, aminoalkylsulfonic acids, aminoalkyl sulfates or phosphates, alkylbetaines and amine oxides; and cationic surface active agents such as alkylamine salts, aliphatic or aromatic quaternary ammonium salts, heterocyclic quaternary ammonium salts such as pyridinium and imidazolium, and aliphatic or heterocyclic phosphonium or sulfonium salts.

As the antistatic agents, fluorine-containing surface active agents described in JP-A No. 60-80849, etc. are preferably used.

The photographic emulsion layers and other hydrophilic colloid layers in the photographic materials of the present invention may contain matting agents such as silica, magnesium oxide and polymethyl methacrylate to prevent adhesion.

The photographic materials of the present invention may contain dispersions of water-insoluble or slightly soluble synthetic polymers to provide dimension stability. For example, alkyl (meth)acrylates, alkoxyacryl (meth)acrylates and glycidyl (meth)acrylates can be used alone or in combination. Further, polymers containing acrylic acid and methacrylic acid as monomer components may be used together in combination with the above polymers.

Gelatin is advantageously used as a binder or a protective colloid for the emulsion layers, but hydrophilic colloids other than gelatin may also be used. Examples of such hydrophilic colloids include proteins such as gelatin derivatives, graft copolymers of gelatin and other polymers, albumin and casein; cellulose derivatives such as hydroxymethyl cellulose, carboxymethyl cellulose and cellulose sulfate esters; saccharide derivatives such as sodium alginate and starch derivatives; and many kinds of synthetic hydrophilic polymer such as homopolymers or copolymers of polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole.

As a gelatin, an acid-processed gelatin, a gelatin hydrolyzate, an enzyme-processed gelatin (e.g., gelatin enzyme-hydrolyzate) can be used as well as a lime-processed gelatin.

The silver halide emulsion layer of the present invention can contain a polymer latex such as an alkyl acrylate.

The supports which can be used in the photographic materials of the present invention include a cellulose triacetate film, a cellulose diacetate film, a nitrocellulose film, a polystyrene film, polyethylene terephthalate paper, baryta paper and polyolefin-coated paper.

There is no particular restriction on the developing agents contained in the developing solutions used in the present invention. It is, however, preferred that the developing agents contain dihydroxybenzene compounds, because good halftone dot quality can be easily obtained. In some cases, a combination of dihydroxybenzene compounds and 1-phenyl-3-pyrazolidone compounds or a combination of dihydroxybenzene compounds and p-aminophenol compounds can be used.

Suitable dihydroxybenzene developing agents used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. In particular, hydroquinone is preferable.

Examples of 1-phenyl-3-pyrazolidone or its derivatives used as developing agents in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

Examples of p-aminophenol developing agents which can used in the present invention include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. In particular, N-methyl-p-aminophenol is preferable.

It is preferred for the developing agents to be present in an amount of 0.05 to 0.8 mol/l. When hydroxybenzene compounds are used in combination with the 1-phenyl-3-pyrazolidone compounds or p-aminophenol compounds, it is preferred that the former compounds are used in an amount of 0.05 to 0.5 mol/l and the latter compounds are used in an amount of 0.06 mol/l or less.

Sulfite preservatives used in the present invention include sodium sulfite, potassium sulfite, lithium sulfite, ammonium sulfite, sodium bisulfite, potassium metabisulfite and formaldehyde sodium bisulfite. The sulfites are used preferably in an amount of 0.3 mol/l or more, and more preferably in an amount of 0.4 mol/l or more. The upper limit thereof is preferably 2.5 mol/l, and more preferably 1.2 mol/l.

Alkali agents used to adjust the pH include pH adjusters and buffers such as sodium hydroxide, potassium hydroxide, sodium carbonate, potassium carbonate, sodium tertiary phosphate, potassium tertiary phosphate, sodium silicate and potassium silicate.

Additives other than the above-described components which may be present in the developing solution include compounds such as boric acid and borax; development inhibitors such as sodium bromide, potassium bromide and potassium iodide; organic solvents such as ethylene glycol, diethylene glycol, triethylene glycol, dimethylformamide, methyl cellosolve, hexylene glycol, ethanol and methanol; and antifoggants such as mercapto compounds (for example, 1-phenyl-5-mercaptotetrazole and the sodium salt of 2-mercaptobenzimidazole-5-sulfonic acid), indazole compounds (for example, 5-nitroindazole) and benzotriazole compounds (for example, 5-methylbenzotriazole). The developing solution may further contain color toning agents, surface active agents, antifoamers, hard water softeners, hardening agents, etc. if desired. In particular, amino compounds described in JP-A No. 56-106244 and imidazole compounds described in JP-B No. 48-35493 (The term "JP-B" as used herein means an "examined Japanese patent publication) are preferable in terms of development acceleration or increase in sensitivity.

The compounds described in JP-A No. 56-24347 can be used in the developing solutions used in the present invention as silver stain preventing agents, the compounds described in JP-A No. 62-212651 can be used as uneven development preventing agents, and the compounds described JP-A No. 61-267759 can be used as dissolution aids.

In the developing solutions used in the present invention, boric acid described in JP-A No. 62-186259, saccharides such as saccharose described in JP-A No. 60-93433, oximes such as acetoxime, phenols such as 5-sulfosalicylic acid, and tertiary phosphates such as the sodium salt and the potassium salt thereof are used as buffers, and boric acid is preferably used.

Fixing solutions are aqueous solutions containing hardening agents (for example, water-soluble aluminum compounds), acetic acid and dibasic acids (for example, tartaric acid, citric acid and salts thereof) if desired, in addition to fixing agents. The fixing solutions preferably have a pH of 3.8 or more and more preferably a pH of 4.0 to 5.5.

The fixing agents include sodium thiosulfate and ammonium thiosulfate. Ammonium thiosulfate is particularly preferable in rate of fixing. The amount of the fixing agents used can be changed appropriately, but it is generally about 0.1 to about 5 mol/l.

Water-soluble aluminum salts which mainly act as hardening agents in fixing solutions are compounds generally known as hardening agents for acidic hardening fixers. Examples of such compounds include aluminum chloride, aluminum sulfate and potassium alum.

Tartaric acid or its derivatives and citric acid or its derivatives can be used alone or in combination as the above-described dibasic acids. It is effective for these compounds to be present in an amount of at least 0.005 mol/l of fixing solution, and particularly in an amount of 0.01 to 0.03 mol/l. Specific examples of these compounds include tartaric acid, potassium tartrate, sodium tartrate, potassium sodium tartrate, ammonium tartrate and potassium ammonium tartrate.

The fixing solutions may further contain preservatives such as sulfites and bisulfites, pH buffers such as acetic acid and boric acid, pH adjuster such as ammonia and sulfuric acid, image stabilizer such as potassium iodide, and chelating agents, if desired. The pH buffers are preferably used in an amount of about 10 to 40 g/l, and more preferably in an amount of about 18 to 25 g/l, because developing solutions have a high pH.

Fixing is preferably carried out at a temperature of about 20° to about 50° C. for a time of 10 seconds to 1 minute, similar to development.

The rinsing water used may contain disinfectants (for example, the compounds described in H. Horiguchi, *Chemistry of Bacteria Prevention and Fungus Prevention* and JP-A No. 62-115154), washing accelerators (for example, sulfites) and chelating agents.

According to the methods described above, the developed and fixed photographic materials are washed with water and dried. Washing is carried out to substantially completely remove silver salts dissolved by fixing, preferably at about 20° to about 50° C. for 10 seconds to 3 minutes. Drying is conducted at about 40° to about 100° C. The drying time can be appropriately changed according to environmental conditions, but a time of about 5 seconds to 3 minutes and 3 seconds is usually sufficient.

Roller transfer type automatic developing machines are described in U.S. Pat. Nos. 3,025,779 and 3,545,971, and briefly referred to as roller transfer type processors herein. A roller transfer type processor comprises the four stages of development, fixing, washing and drying. Although the methods used in the present invention do not exclude other stages such as a stopping stage, it is most preferred to employ these four stages. The use of a two- or three-stage countercurrent system in the washing stage reduces the amount of rinsing water.

It is preferred that the developing solutions used in the present invention are stored in containers with low oxygen permeability described in JP-A No. 61-73147. The replenishing system described in JP-A No. 62-91939 can be preferably used for the developing solutions used in the present invention.

The silver halide photographic materials of the present invention provide high Dmax. For this reason, when the photographic materials are subjected to reduction processing after images have been formed, the density is kept high even if the halftone dot area is decreased.

There is no particular restriction on reducers which can be used in the present invention. For example, the reducers can be used which are described in Mees, *The Theory of the Photographic Process*, pages 738 to 744, Macmillan (1954), Tetsuo Yano, *Photographic Processing, The Theory and Practice*, pages 166 to 169, Kyoritsu Shuppan (1978), JP-A Nos. 50-27543, 52-68429, 55-17123, 55-79444, 57-10140, 57-142639 and 61-61155. Namely, suitable reducers are permanganates, persulfates, ferric salts, cupric salts, ceric salts, red prussiate (potassium ferrocyanide) and bichromates, used alone or in combination as oxidizing agents, and inorganic acids such as sulfuric acid and alcohols are further added thereto, if desired. Reducers are also used which contain oxidizing agents such as red prussiate (potassium ferrocyanide) and ethylenediaminetetraacetic acid ferric salt, and solvents for silver halides such as thiosulfates, rhodanates, thiourea and derivatives thereof, and further contain inorganic acids such as sulfuric acid, if desired.

Typical examples of reducers which can be used in the present invention include the so-called Farmer's reducer, ethylenediaminetetraacetic acid ferric salt, potassium permanganate, ammonium persulfate reducer (Kodak R-5) and ceric salt reducers.

It is preferred that reduction processing is generally performed at a temperature of 10° to 40° C., particularly 15° to 30° C., for a time of several seconds to several tens of minutes, particularly within several minutes. By using the photographic materials for plate making of the-present invention, a sufficiently wide reduction width can be obtained within the range of these conditions.

Specifically, reduction processing can be carried out by various methods. For example, a photographic material for plate making is immersed in the reducer and the reducer is stirred, or the reducer is applied to the surface of the photographic material for plate making with a brush or a roll.

The present invention is further described in greater detail by reference to the following examples, which are however not to be construed as limiting the invention. Unless otherwise indicated herein, all parts, percents, ratios and the like are by weight.

A developing solution having the following formula was used in the examples.

| | |
|---|---|
| Potassium Sulfite | 67 g |
| Ethylenediamine-4-acetic Acid-2-sodium | 3.0 g |
| Hydroquinone | 23 g |
| 4-Hydroxymethyl-4-methyl-1-phenyl-3-pyrazolidone | 0.4 g |
| Sodium 2-Mercaptobenzimidazole-5-sulfonate | 0.3 g |
| Potassium Hydroxide | 11 g |
| 5-Methylbenzotriazole | 0.1 g |
| Sodium Carbonate | 11 g |
| Potassium Bromide | 3.0 g |
| Water to-make 1 liter (adjusted to pH 10.7) | |

EXAMPLE 1

Emulsions (A) and (B) were prepared by the following method.

Emulsion (A)

An aqueous solution of silver nitrate and an aqueous solution of sodium chloride containing a transition metal in the amount shown in Table 1 below were concurrently added to an aqueous solution of gelatin kept at 40° C. for 3.5 minutes, and the potential was controlled to 95 mV to prepare core grains. Then, an aqueous solution of silver nitrate and an aqueous solution of sodium chloride were simultaneously added thereto over a 7 minute period, and the potential was controlled to 95 mV to prepare cubic silver chloride grains containing a transition metal in the core portions thereof with a mean grain size of 0.14 μm.

The transition metal coordinate complexes contained in Emulsion (A) and the compounds represented by formula (I) or (II) which were added are shown in Table 1 below.

Emulsion (B)

Grains were prepared in the same manner as in Emulsion (A). However, the transition metal was added so as to give a core-shell ratio (by weight) of 1:3. The overall mean amounts added are shown in Table 1 below. The thus obtained grains were cubic silver halide grains having a mean grain size of 0.14 μm.

The transition metal coordinate complexes present in Emulsion (B) and the compounds represented by formula (I) or (II) which were added are shown in Table 1 below.

Preparation of Coated Samples

To Emulsion (A) or (B), 2.5 mg/m$^2$ of 1-phenyl-5-mercaptotetrazole, 770 mg/m$^2$ of an ethyl acrylate latex (mean grain size: 0.05 μm) and a compound for comparison or a compound of the present invention as shown in Table 1 below were added, and 126 mg/m$^2$ of 2-bis(-vinylsulfonylacetoamide)ethane was added thereto as a hardening agent. A polyester support was coated with the resulting solution to achieve a silver coated amount of 3.0 g/m$^2$. The coated amount of gelatin was 1.5 g/m$^2$.

As a lower protective layer, 0.8 g/m$^2$ of gelatin, 8 mg/m$^2$ of lipoic acid and 230 mg/m$^2$ of an ethyl acrylate latex (mean grain size: 0.05 μm) were coated thereon, and 0.7 g/m$^2$ of gelatin and the following Dye (I) were further coated thereon in a solid dispersion state as an upper protective layer. At this time, 55 mg/m$^2$ of a matting agent (silicon dioxide, mean grain size: 3.5 μm), 135 mg/m$^2$ of methanol silica (mean grain size: 0.02 μm), of sodium dodecylbenzenesulfonate as a coating aid, 20 mg/m$^2$ of the sulfuric ester sodium salt of polyoxyethylene nonyl phenyl ether (polymerization degree: 5) and 3 mg/m$^2$ of N-perfluorooctanesulfonyl-N-propylglycine potassium salt were concurrently coated thereon to prepare a sample.

Dye (I)

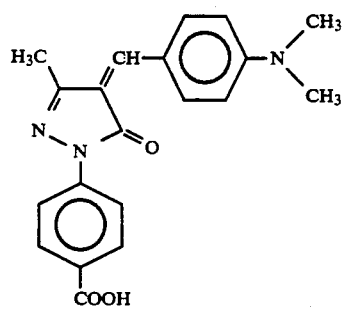

The support used in this example had a backing layer and a back protective layer of the following composition:

| | |
|---|---|
| Backing Layer | |
| Gelatin | 170 mg/m$^2$ |
| Sodium Dodecylbenzenesulfonate | 32 mg/m$^2$ |
| Sodium Dihexyl-α-sulfosuccinate | 35 mg/m$^2$ |
| $SnO^2$/Sb (9/1 ratio by weight, mean grain size: 0.25 μm) | 318 mg/m$^2$ |
| Back Protective Layer | |
| Gelatin | 2.7 g |
| Silicon Dioxide Matting Agent (mean grain size: 3.5 μm) | 26 mg/m$^2$ |
| Sodium Dihexyl-α-sulfosuccinate | 20 mg/m$^2$ |
| Sodium Dodecylbenzenesulfonate | 67 mg/m$^2$ |

-continued $C_8F_{17}SO_2N(C_3H_7)-(CH_2CH_2O)_n-(CH_2)_4-SO_3Li$ 5 mg/m²

Dye A 190 mg/m²

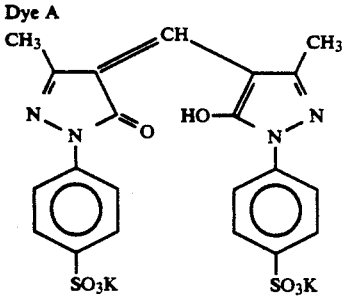

Dye B 32 mg/m²

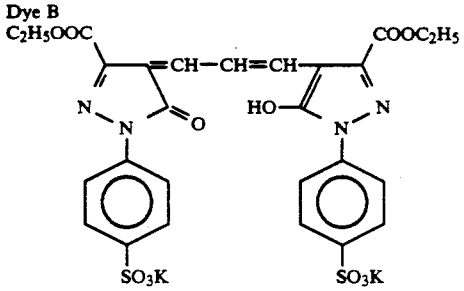

Dye C 59 mg/m²

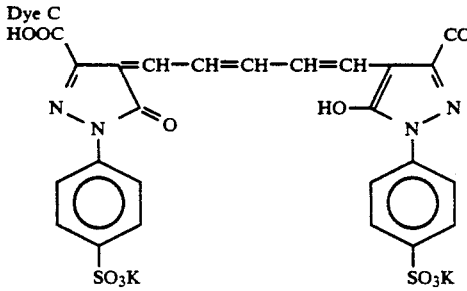

-continued

| | |
|---|---|
| Ethyl Acrylate Latex (mean grain size: 0.05 μm) | 260 mg/m² |
| 1,3-Divinyl-sulfonyl-2-propanol | 149 mg/m² |

Photographic Characteristics

The samples thus obtained were exposed through a light wedge with a p-627FM printer (mercury) manufactured by Dainippon Screen Mfg. Co., Ltd., and developed at 38° C. for 20 seconds using a developing solution LD-835 and an automatic processor FG800RA manufactured by Fuji Photo Film Co. Ltd. Then, the samples were fixed, washed and dried. The following characteristics of these samples were evaluated.

1) γ

$$\gamma = (1.5 - 0.1)/-\{\log(\text{exposure amount giving a density of } 0.1) - \log(\text{exposure amount giving a density of } 1.5)\}$$

2) Dmax and Dmax(−1%)

A film (halftone dot original) on which halftone dot images were formed was fixed on a holding support with an adhesive tape, and each film sample was brought into close contact with the above-described halftone dot original so as to overlap with each other in a surface-to-surface manner. The maximum blackened densities obtained when each sample was exposed so that a halftone dot area of 50% was turned to 50% and 49% were taken as Dmax and Dmax(−1%), respectively.

(3) Thermo Property ($\Delta S_{1.5}$)

After standing under conditions of 50° C. and 75% for 3 days, each film sample was subjected to the above-described exposure, development, fixing, washing and drying. The difference between the sensitivity at the time when a density of 1.5 was achieved and that immediately after coating was evaluated. The smaller this value is, the better the thermo property is.

TABLE 1

| No. | Emulsion | Metal Added and Mean Content (mol/mol of silver) | | Compound No. of Formula (I) or (II) and Amount Thereof (mol/mol of silver) | |
|---|---|---|---|---|---|
| 1 | A | $(NH_4)_3RhCl_6$ | $5 \times 10^{-6}$ | — | |
| 2 | A | $(NH_4)_3RhCl_6$ | $5 \times 10^{-6}$ | No. 6 | $5 \times 10^{-3}$ |
| 3 | A | $K_2Ru(NO)Cl_5$ | $5 \times 10^{-6}$ | — | |
| 4 | A | $K_2Ru(NO)Cl_5$ | $5 \times 10^{-6}$ | Compound for Comparison (I) | $5 \times 10^{-3}$ |
| 5 | A | $K_2Ru(NO)Cl_5$ | $5 \times 10^{-6}$ | No. 6 | $5 \times 10^{-3}$ |
| 6 | A | $(NH_4)_2Rh(NO)Cl_5$ | $5 \times 10^{-6}$ | Compound for Comparison (II) | $5 \times 10^{-3}$ |
| 7 | A | $(NH_4)_2Rh(NO)Cl_5$ | $5 \times 10^{-6}$ | No. 7 | $5 \times 10^{-3}$ |
| 8 | A | $K_2Re(NO)Cl_5$ | $5 \times 10^{-6}$ | Compound for Comparison (I) | $3 \times 10^{-3}$ |
| 9 | A | $K_2Re(NO)Cl_5$ | $5 \times 10^{-6}$ | No. 10 | $3 \times 10^{-3}$ |
| 10 | B | $(NH_4)_3RhCl_6$ | $1 \times 10^{-4}$ | — | |
| 11 | B | $(NH_4)_3RhCl_6$ | $1 \times 10^{-4}$ | No. 6 | $5 \times 10^{-3}$ |
| 12 | B | $K_2Ru(NO)Cl_5$ | $5 \times 10^{-5}$ | Compound for Comparison (I) | $5 \times 10^{-3}$ |
| 13 | B | $K_2Ru(NO)Cl_5$ | $5 \times 10^{-5}$ | No. 6 | $5 \times 10^{-3}$ |
| 14 | B | $(NH_4)_2Rh(NO)Cl_5$ | $1 \times 10^{-4}$ | — | |
| 15 | B | $(NH_4)_2Rh(NO)Cl_5$ | $1 \times 10^{-4}$ | Compound for Comparison (II) | $5 \times 10^{-3}$ |
| 16 | B | $(NH_4)_2Rh(NO)Cl_5$ | $1 \times 10^{-4}$ | No. 7 | $5 \times 10^{-3}$ |
| 17 | B | $K_2Re(NO)Cl_5$ | $1 \times 10^{-4}$ | Compound for Comparison (I) | $3 \times 10^{-3}$ |
| 18 | B | $K_2Re(NO)Cl_5$ | $1 \times 10^{-4}$ | No. 10 | $3 \times 10^{-3}$ |
| 19 | B | $(NH_4)_2Rh(SN)Cl_5$ | $1 \times 10^{-4}$ | Compound for Comparison (I) | $5 \times 10^{-3}$ |

TABLE 1-continued

| | | | | | |
|---|---|---|---|---|---|
| 20 | B | $(NH_4)_2Rh(SN)Cl_5$ | $1 \times 10^{-4}$ | No. 7 | $5 \times 10^{-3}$ |

Compound for Comparison (I)

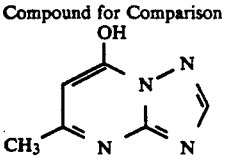

Compound for Comparison (II)

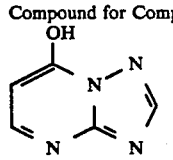

TABLE 2

| No. | Photographic Characteristics γ[1)] | Dmax[2)] | Dmax(−1%)[2)] | Thermo Property $\Delta S_{1.5}$[3)] | |
|---|---|---|---|---|---|
| 1 | 5.5 | 5.3 | 4.9 | +0.16 | |
| 2 | 5.1 | 5.4 | 5.0 | +0.02 | |
| 3 | 6.4 | 5.4 | 5.1 | +0.20 | |
| 4 | 6.9 | 5.5 | 5.1 | +0.10 | |
| 5 | 7.6 | 5.6 | 5.5 | +0.02 | Invention |
| 6 | 7.0 | 5.5 | 5.1 | +0.11 | |
| 7 | 7.8 | 5.6 | 5.5 | +0.02 | Invention |
| 8 | 6.8 | 5.4 | 5.0 | +0.10 | |
| 9 | 7.4 | 5.6 | 5.5 | +0.02 | Invention |
| 10 | 2.8 | 2.2 | 2.0 | +0.15 | |
| 11 | 5.0 | 5.1 | 4.8 | −0.03 | |
| 12 | 3.9 | 3.7 | 3.4 | +0.12 | |
| 13 | 6.5 | 5.5 | 5.1 | +0.02 | Invention |
| 14 | 3.0 | 2.5 | 2.3 | +0.26 | |
| 15 | 4.0 | 3.8 | 3.4 | +0.13 | |
| 16 | 6.8 | 5.6 | 5.2 | +0.02 | Invention |
| 17 | 4.0 | 4.0 | 3.5 | +0.15 | |
| 18 | 6.6 | 5.6 | 5.1 | +0.02 | Invention |
| 19 | 3.8 | 3.8 | 3.5 | +0.10 | |
| 20 | 6.5 | 5.5 | 5.1 | +0.02 | Invention |

As is apparent from the results in Table 2, the samples of the present invention have hard foot gradation and high Dmax, particularly high Dmax at the time when insufficiently exposed, and further the samples had excellent thermo properties.

EXAMPLE 2

An aqueous solution of silver nitrate and an aqueous solution of sodium chloride containing a metal in an amount of $5 \times 10^{-5}$ mol/mol of silver as shown in Table 3 below were simultaneously added to an aqueous solution of gelatin kept at 40° C. for 3.5 minutes, and the potential was controlled to 95 mV to prepare core grains having a size of 0.11 μm. Then, an aqueous solution of silver nitrate and an aqueous solution of sodium chloride containing the metal in an amount of $1.5 \times 10^{-4}$ mol/mol of silver as shown in Table 3 below were simultaneously added thereto for 7 minutes, and the potential was controlled to 95 mV to prepare cubic silver chloride grains having a mean grain size of 0.14 μm.

Preparation of Coated Samples

To each emulsion, 2.5 mg/m² of 1-phenyl-5-mercaptotetrazole, 770 mg/m² of an ethyl acrylate latex (mean grain size: 0.05 μm) and a compound for comparison or a compound of the present invention shown in Table 3 below were added, and 126 mg/m² of 2-bis(vinylsulfonylacetoamide)ethane was added thereto as a hardening agent. A polyester support was coated with the resulting solution in a silver coated amount of 3.0 g/m². The coated amount of gelatin was 1.5 g/m².

As a lower protective layer, 0.8 g/m² of gelatin, 8 mg/m² of lipoic acid and 230 mg/m² of the ethyl acrylate latex (mean grain size: 0.05 μm), were coated thereon, and 0.7 g/m² of gelatin and Dye (I) described in Example 1 were further coated thereon in a solid dispersion state as an upper protective layer. At this time, 55 mg/m² of a matting agent (silicon dioxide, mean grain size: 3.5 μm), 135 mg/m² of methanol silica (mean grain size: 0.02 μm), 25 mg/m² of sodium dodecylbenzenesulfonate as a coating aid, 20 mg/m² of the sodium salt of polyoxyethylene nonyl phenyl ether sulfuric acid ester (polymerization degree: 5) and 3 mg/m² of N-perfluorooctanesulfonyl-N-propylglycine potassium salt were simultaneously coated thereon to prepare a sample.

The support used in this example had a backing layer and a back protective layer of the following composition (the degree of swelling of the back side is 110%):

| | |
|---|---|
| Backing Layer | |
| Gelatin | 170 mg/m² |
| Sodium Dodecylbenzenesulfonate | 32 mg/m² |
| Sodium Dihexyl-α-sulfosuccinate | 35 mg/m² |
| $SnO_2$/Sb (9/1 ratio by weight, mean grain size: 0.25 μm) | 318 mg/m² |
| Back Protective Layer | |
| Gelatin | 2.7 g |
| Silicon Dioxide Matting Agent (mean grain size: 3.5 μm) | 26 mg/m² |
| Sodium Dihexyl-α-sulfosuccinate | 20 mg/m² |
| Sodium Dodecylbenzenesulfonate | 67 mg/m² |
| $C_8F_{17}SO_2N(C_3H_7)-(CH_2CH_2O)_n-(CH_2)_4-SO_3Li$ | 5 mg/m² |
| Dye A | 190 mg/m² |

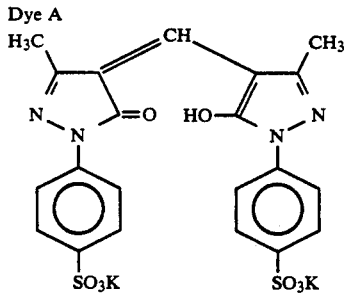

| | |
|---|---|
| Dye B | 32 mg/m² |

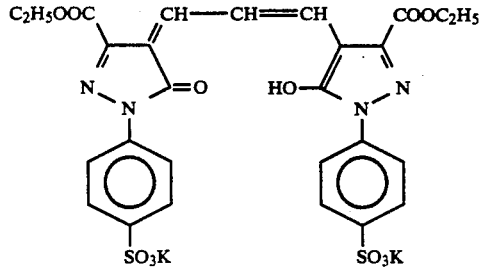

| | |
|---|---|
| Dye C | 59 mg/m² |

-continued

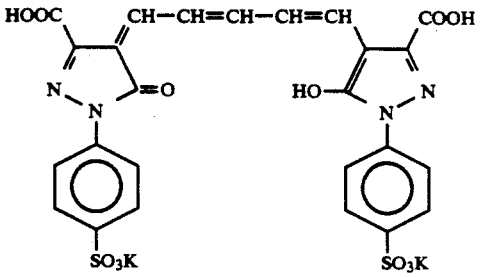

| | |
|---|---|
| Ethyl Acrylate Latex (mean grain size: 0.05 μm) | 260 mg/m² |
| 1,3-Divinyl-sulfonyl-2-propanol | 149 mg/m² |

Photographic Characteristics

The thus samples obtained were exposed through a light wedge with a p-627FM printer (mercury) manufactured by Dainippon Screen Mfg. Co., Ltd., and developed at 38° C. for 20 seconds using a developing solution LD-835 and an automatic processor FG800RA manufactured by Fuji Photo Film Co. Ltd. Then, the samples were fixed, washed and dried. The following characteristics of these samples were evaluated.

1) γ

$$\gamma = (1.5 - 0.1)/-\{\log(\text{exposure amount giving a density of } 0.1) - \log(\text{exposure amount giving a density of } 1.5)\}$$

2) Dmax and Dmax(−1%)

A film (halftone dot original) on which halftone dot images were formed was fixed on a holding support with adhesive tape, and each film sample was brought into close contact with the above-described halftone dot original to overlap each other in a surface-to-surface manner. The maximum blackened densities obtained when each sample was exposed so that a halftone dot area of 50% was changed to 50% and 49% were taken as Dmax and Dmax(−1%), respectively.

3) Shelf Life (Δfog)

After standing under conditions of 60° C. and 30% (RH) for 5 days, the Dmin of each sample was evaluated by an increase to initial property.

TABLE 3

| No. | Metal Added and Mean Content (mol/mol of silver) | | Compound No. of Formulae (III) to (V) and Amount Thereof (mg/m²) | |
|---|---|---|---|---|
| 1 | $(NH_4)_3RhCl_6$ | $1 \times 10^{-4}$ | — | |
| 2 | $(NH_4)_3RhCl_6$ | $1 \times 10^{-4}$ | No. 39 | (10) |
| 3 | $K_2Ru(NO)Cl_5$ | $1 \times 10^{-4}$ | — | |
| 4 | $K_2Ru(NO)Cl_5$ | $1 \times 10^{-4}$ | No. 39 | (10) |
| 5 | $K_2Ru(NO)Cl_5$ | $1 \times 10^{-4}$ | No. 28 | (15) |
| 6 | $K_2Re(NO)Cl_5$ | $1 \times 10^{-4}$ | — | |
| 7 | $K_2Re(NO)Cl_5$ | $1 \times 10^{-4}$ | No. 40 | (10) |
| 8 | $K_2Re(NO)Cl_5$ | $1 \times 10^{-4}$ | No. 28 | (20) |
| 9 | $K_2Rh(NO)Cl_5$ | $1 \times 10^{-4}$ | — | |
| 10 | $K_2Rh(NO)Cl_5$ | $1 \times 10^{-4}$ | No. 39 | (10) |
| 11 | $K_2Rh(NO)Cl_5$ | $1 \times 10^{-4}$ | No. 33 | (15) |
| 12 | $K_2Ru(NS)Cl_5$ | $1 \times 10^{-4}$ | — | |
| 13 | $K_2Ru(NS)Cl_5$ | $1 \times 10^{-4}$ | No. 26 | (10) |
| 14 | $K_2Ru(NS)Cl_5$ | $1 \times 10^{-4}$ | No. 33 | (20) |

| No. | Photographic Characteristics γ[1)] | Dmax[2)] | Dmax(−1%)[2)] | Keeping Property Δfog[3)] | |
|---|---|---|---|---|---|
| 1 | 5.0 | 5.1 | 4.8 | +0.03 | |
| 2 | 5.0 | 5.1 | 4.8 | +0.03 | |
| 3 | 6.8 | 5.6 | 5.2 | +0.10 | |
| 4 | 6.8 | 5.6 | 5.2 | +0.03 | Invention |
| 5 | 6.8 | 5.6 | 5.2 | +0.03 | Invention |
| 6 | 6.8 | 5.6 | 5.1 | +0.11 | |
| 7 | 6.8 | 5.6 | 5.1 | +0.03 | Invention |
| 8 | 6.8 | 5.6 | 5.1 | +0.03 | Invention |
| 9 | 6.8 | 5.6 | 5.2 | +0.10 | |
| 10 | 6.8 | 5.6 | 5.2 | +0.03 | Invention |
| 11 | 6.8 | 5.6 | 5.2 | +0.03 | Invention |
| 12 | 6.7 | 5.5 | 5.1 | +0.12 | |
| 13 | 6.7 | 5.5 | 5.1 | +0.03 | Invention |
| 14 | 6.7 | 5.5 | 5.1 | +0.03 | Invention |

The data in Table 3 above demonstrates that the samples according to the present invention result in consistently superior fog, foot gradation and Dmax values in comparison to those of the prior art. This superiority means that the inventive samples have excellent dot to dot work properties.

According to the present invention, the silver halide emulsion contains silver halide grains in which a nitrosyl or thionitrosyl ligand and a transition metal are present, and at least one compound represented by formula (I), (II), (III), (IV) or (V) is also present, whereby the photographic material treated under daylight circumstances-can be prevented from a blackened density decrease on under-exposure.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer and another hydrophilic colloid layer wherein the emulsion layer comprises a silver halide emulsion containing a compound having a nitrosyl ligand or a thionitrosyl ligand and a transition metal selected from the group consisting of the elements belonging to Groups V to X of the Periodic Table in an amount of $1 \times 10^{-6}$ mol or more per mol of silver, and at least one of the silver halide emulsion layer and the other hydrophilic colloid layer contains at least one compound represented by formula (I), (II), (III), (IV) or (V):

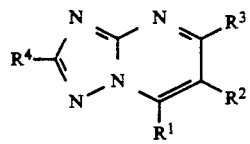

(I)

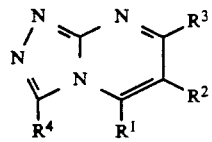

(II)

$Z-SO_2-S-M$ (III)

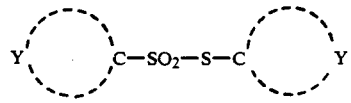

(IV)

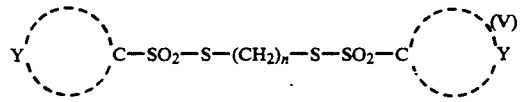

(V)

wherein each of $R^1$, $R^2$, $R^3$ and $R^4$, which may be the same or different, represents a hydrogen atom, an alkyl group, an aryl group, an amino group, a hydroxyl group, an alkoxy group, an alkylthio group, a carbamoyl group, a halogen atom, a cyano group, a carboxyl group, an alkoxycarbonyl group or a heterocyclic group, and $R^1$ and $R^2$ or $R^2$ and $R^3$ may combine together to form a five-membered or six-membered ring, provided that at least one of $R^1$ and $R^3$ represents a hydroxyl group and the total number of carbon atoms of $R^1$, $R^2$, $R^3$ and $R^4$ is at least 2; Z represents an alkyl group having 1 to 18 carbon atoms, an aryl group having 6 to 18 carbon atoms or a heterocyclic group; Y represents the atoms necessary to form an aromatic ring having 6 to 18 carbon atoms or a heterocyclic ring; M represents a metal atom or an organic cation; and n is an integer of 2 to 10.

2. The silver halide photographic material as in claim 1, wherein the transition metal is present in the form of a metal coordinate complex.

3. The silver halide photographic material as in claim 2, wherein the metal coordinate complex has the formula $$[M(NY)L_5]^m$$

wherein M is a transition metal selected from the group consisting of elements belonging to Groups V to X of the Periodic Table; L represents a bridging ligand, provided that one of five L groups may be substituted for (NY); Y represents oxygen or sulfur; and m is 0, −1, −2, or −3.

4. A silver halide photographic material as in claim 1, wherein the compound of formula (I), (II) (III), (IV) or (V) is used in an amount of $1\times10^{-5}$ to $\times10^{-3}$ mol per mol of silver.

* * * * *